US007335061B2

(12) United States Patent
Ciriello et al.

(10) Patent No.: US 7,335,061 B2
(45) Date of Patent: Feb. 26, 2008

(54) ELECTRIC CONNECTOR

(75) Inventors: Tommasino Ciriello, Venaria (IT); Pier Carlo Bigotto, Cascine Vica Rivoli (IT)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/571,549

(22) PCT Filed: Sep. 15, 2004

(86) PCT No.: PCT/EP2004/052193

§ 371 (c)(1),
(2), (4) Date: Dec. 22, 2006

(87) PCT Pub. No.: WO2005/027268

PCT Pub. Date: Mar. 24, 2005

(65) Prior Publication Data

US 2007/0128953 A1 Jun. 7, 2007

(30) Foreign Application Priority Data

Sep. 16, 2003 (IT) ..... TO2003A0709

(51) Int. Cl.
*H01R 13/40* (2006.01)

(52) U.S. Cl. ..... 439/595

(58) Field of Classification Search ..... 439/595, 439/598, 752, 592, 488–489, 599
See application file for complete search history.

(56) References Cited

U.S. PATENT DOCUMENTS 5,085,599 A 2/1992 Maejima et al. ..... 439/595
5,160,279 A * 11/1992 Sagawa et al. ..... 439/595
5,738,543 A * 4/1998 Rollins et al. ..... 439/595

FOREIGN PATENT DOCUMENTS

DE 197 06 992 A1 8/1998
EP 0 344 691 A2 12/1989

* cited by examiner

*Primary Examiner*—Edwin A. Leon
(74) *Attorney, Agent, or Firm*—Harrington & Smith, PC

(57) ABSTRACT

An electric connector (1) having an insulating casing (2) defining a number of cavities (3) for housing respective electric terminals (4) and having respective axes parallel to a mating direction (A) in which the connector (1) mates with a complementary connector; primary retaining means (30) for retaining the terminals (4) inside the respective cavities (3); and secondary retaining means (31) for determining correct engagement of the terminals (4) by the primary retaining means (30), and preventing release of the terminals; the secondary retaining means (31) include a movable member (32) which engages the casing (2), in the mating direction (A), in a first operating position, and which is movable, in a direction (B) crosswise to the mating direction (A), from the first operating position to a final second operating position in which it cooperates with the terminals (4) to prevent withdrawal of the terminals from the cavities (3).

9 Claims, 5 Drawing Sheets

ELECTRIC CONNECTOR

TECHNICAL FIELD

The present invention relates to an electric connector, in particular for automotive applications.

BACKGROUND ART

As is known, in the automotive industry, electric connecting units are used comprising two complementary connectors mating in a predetermined direction.

Each connector normally comprises an insulating casing defining a number of cavities for housing respective electric terminals and having respective axes parallel to the mating direction of the connector to the complementary connector.

The terminals are retained inside the respective cavities by flexible primary retaining lances normally formed in one piece with the casing.

More specifically, the lances project inside the respective cavities from one of the walls defining the cavities, and are deformable elastically in a direction crosswise to the mating direction of the connectors to click inside respective seats for receiving the terminals.

Alternatively, in another known solution, the flexible lances are formed in one piece with the terminals, and click inside respective retaining seats formed in the walls defining the respective cavities.

Known connectors also comprise a secondary retaining device for determining correct insertion of the terminals inside the respective cavities, and which also acts as a further safety device for ensuring retention of the terminals inside the cavities.

The secondary retaining device normally comprises a movable member which clicks onto the casing, and which may either be hinged integrally to the casing or defined by a separate member. In both cases, the movable member can only click onto the casing when the terminals are all fully inserted correctly and retained inside the respective cavities by the primary retaining lances.

Two widely differing types of secondary retaining devices exist, depending on the direction in which the movable member engages the casing.

In a first type, the movable member engages the front of the casing, i.e. in a direction parallel to the mating direction of the connectors. Examples of this type of secondary retaining device are described and illustrated in Patent Applications EP-A-1107383 and EP-A-1257007.

As described in the above applications, the movable member is defined integrally by a plate and a number of wedges projecting perpendicularly from the plate. Each wedge is inserted between the respective primary retaining lance and the wall from which the lance extends; and, in the event one of the terminals is not correctly or fully inserted inside the respective cavity, the respective primary retaining lance remains deformed, thus preventing insertion of the respective wedge. Once the movable member correctly engages the casing, the wedges prevent the primary retaining lances from deforming accidentally and so releasing the terminals.

In other words, the movable member cooperates directly with the primary retaining lances to prevent undesired deformation of the lances in use, but in no way interacts with the terminals, which are therefore retained solely by the primary retaining lances.

In the second type of secondary retaining device, the movable member is inserted laterally inside the casing, i.e. crosswise to the mating direction of the connectors.

In this case, the movable member is positioned with portions of it facing respective shoulders on the terminals, so as to define terminal stops in the withdrawal direction and so actually perform a secondary retaining function, i.e. in addition to that of the primary retaining lances.

In situations requiring airtight connecting units, i.e. with sealing means interposed between the mating portions of the two connectors defining the unit, laterally inserted secondary retaining devices cannot always be used.

That is, to avoid impairing the seal, laterally inserted secondary retaining devices can only be used on the portion of the connector designed to fit inside the other connector, whereas, on the outer connector, front-engaging secondary retaining devices must be employed, but which, as stated, do not actually perform any secondary retaining action on the terminals.

DISCLOSURE OF INVENTION

It is an object of the present invention to provide an electric connector designed to eliminate the aforementioned drawbacks of known connectors in a straightforward, low-cost manner.

According to the present invention, there is provided an electric connector comprising:

an insulating casing having at least one cavity for housing a respective electric terminal and having an axis parallel to a first direction in which the connector mates with a complementary connector;

primary retaining means for retaining said terminal inside said cavity;

secondary retaining means for determining correct engagement of said terminal by said primary retaining means, and comprising at least one movable member which fits inside said casing, in said first direction, in a first operating position;

characterized in that said movable member is movable, in a second direction crosswise to said first direction, from said first operating position to a final second operating position in which it cooperates with said terminal to prevent withdrawal of the terminal from said cavity.

BRIEF DESCRIPTION OF THE DRAWINGS

A preferred, non-limiting embodiment of the present invention will be described by way of example with reference to the accompanying drawings, in which.

BEST MODE FOR CARRYING OUT THE INVENTION

Figure 1:
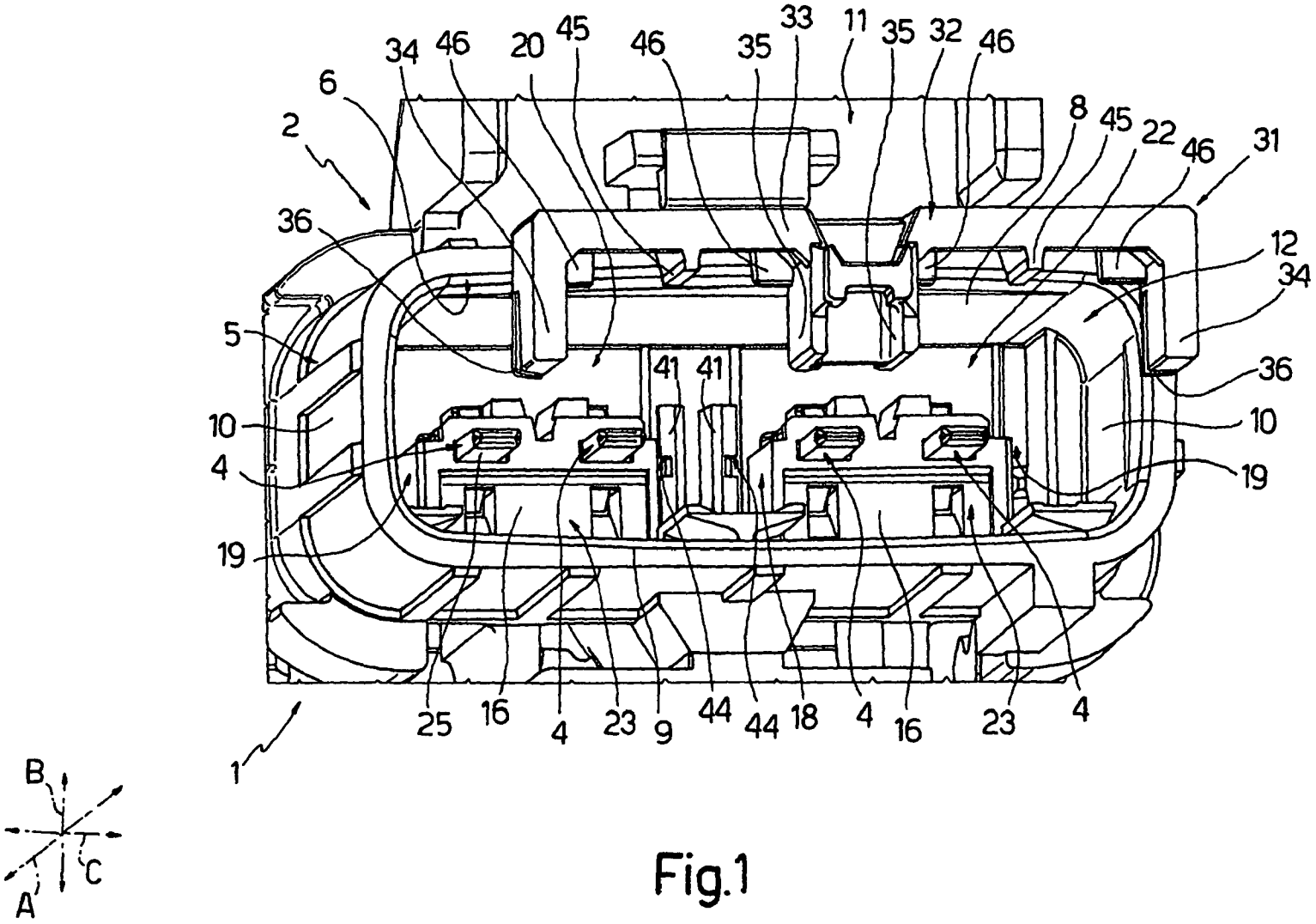
FIG. 1 shows an exploded view in perspective of an electric connector in accordance with the present invention.

With reference to FIGS. 1 to 7, number 1 indicates as a whole an electric connector in accordance with the teachings of the present invention.

It should be pointed out that the terms "top", "bottom", "front", "rear" and similar used in the following description are in no way limiting, and are used solely for the sake of clarity with reference to the position of connector 1 as shown in FIGS. 1 to 7.

Connector 1 comprises an insulating casing 2 defining a number of—in the example shown, four—longitudinal through cavities 3 having respective axes parallel to a direction A in which connector 1 mates with a complementary connector (not shown), and for receiving respective known male electric terminals 4.

Casing 2 comprises a substantially parallelepiped-shaped main body 5 having a front opening 6 and bounded by a rear wall 7 opposite opening 6, by two respectively top and bottom walls 8 and 9, and by two lateral walls 10. Casing 2 also comprises an auxiliary body 11 fitted in conventional manner to main body 5 along top wall 8, and not described herein by not being essential to a clear understanding of the present invention.

Main body 5 is substantially defined by a hollow front portion 12 communicating externally via opening 6, and by a solid rear portion 15 in which cavities 3 of terminals 4 are formed.

Rear portion 15 projects partly inside hollow front portion 12 in the form of two substantially parallelepiped-shaped blocks 16, in each of which are formed the front portions of a relative pair of cavities 3.

Blocks 16 project from bottom wall 9, are separated by a central corridor 18, and define respective lateral corridors 19 with the two lateral walls 10, and a top gap 20 with top wall 8. Lateral corridors 19, central corridor 18, and top gap 20 come out at the front inside an inlet 21 interposed between front opening 6 and blocks 16 and for receiving a matching shaped portion of the complementary connector.

Blocks 16 extend from a rear surface 22 of front portion 12, and are bounded, at the opposite end, by respective front surfaces 23, from which terminals 4 project in use.

Figure 6:
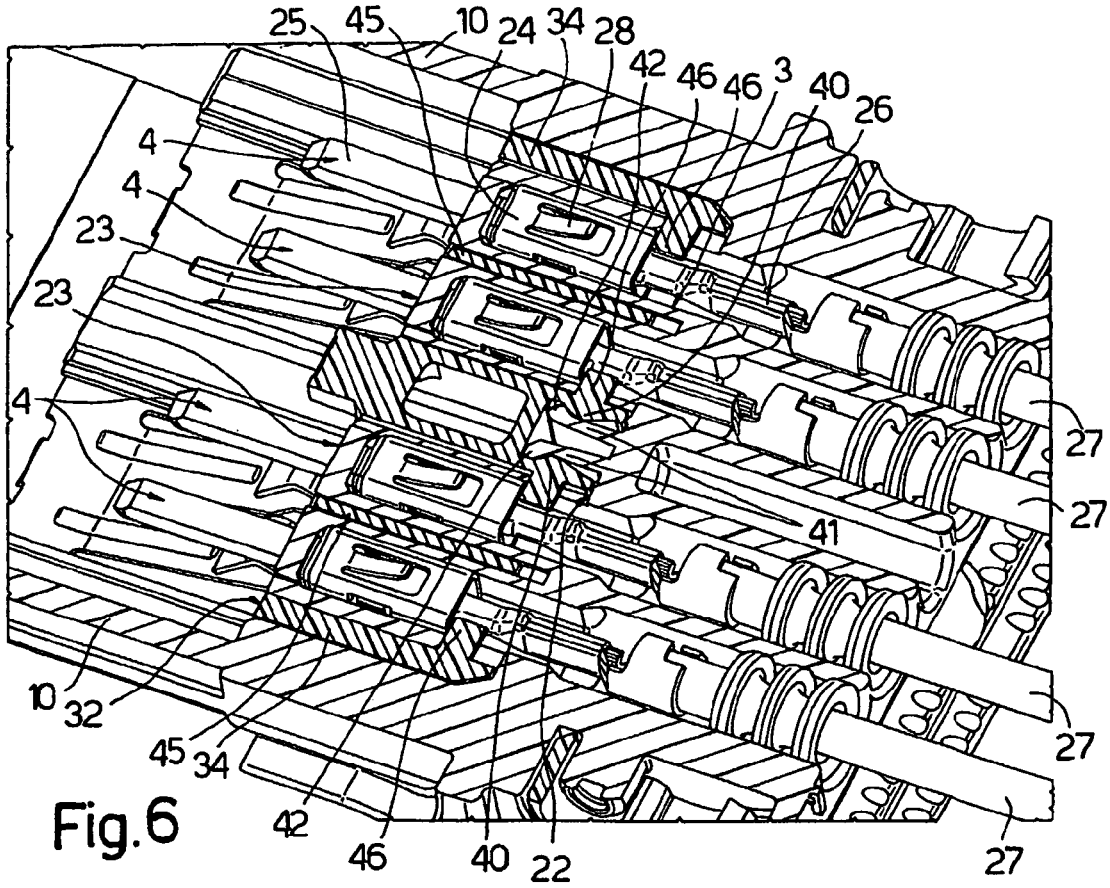
FIG. 6 shows a horizontal section in perspective of the FIG. 3 connector.
Figure 7:
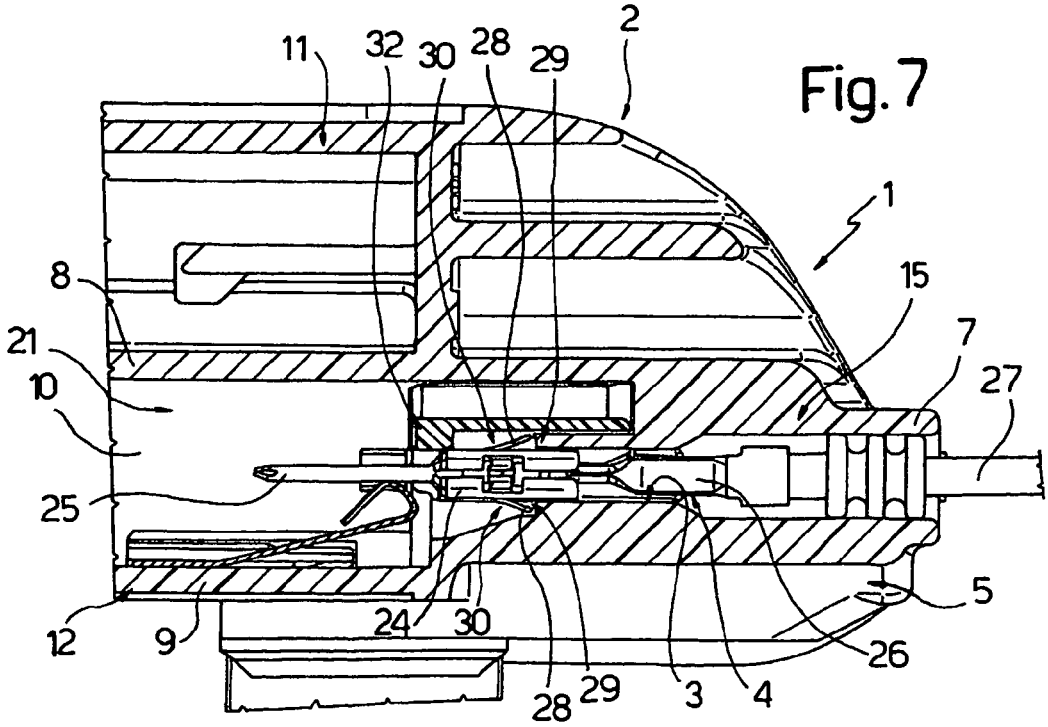
FIG. 7 shows a vertical section of the FIG. 3 connector.

With particular reference to FIGS. 6 and 7, each terminal 4 comprises a box-shaped intermediate portion 24; a blade-like contact portion 25 projecting frontwards from intermediate portion 24; and a rear connecting portion 26 smaller in section than intermediate portion 24, and for connection to an electric cable 27.

Each terminal 4 is inserted inside respective cavity 3 through an opening formed in rear wall 7 of casing 2, from which cable 27 extends, and contact portion 25 projects axially inside inlet 21 through a front opening of cavity 3 formed in front surface 23 of relative block 16.

Opposite top and bottom walls of intermediate portion 24 of each terminal 4 have respective elastic retaining tabs 28, which click in known manner inside respective retaining seats 29 formed in the walls of relative cavity 3. Tabs 28 and respective seats 29 together define primary retaining means 30 for retaining terminals 4 inside respective cavities 3 and preventing withdrawal of the terminals.

More specifically, tabs 28 of each terminal 4 project from the relative walls of intermediate portion 24 towards connecting portion 26, so as to flex elastically towards the walls of intermediate portion 24 as terminal 4 is inserted inside respective cavity 3 through the opening in rear wall 7, and then click back into the undeformed retaining configuration on reaching retaining seats 29.

To retain terminals 4, connector 1 also comprises a secondary retaining device indicated as a whole by 31 (and shown separately in FIGS. 9 and 10) and defined by a plate-like movable member 32 separate from casing 2.

Figure 2:
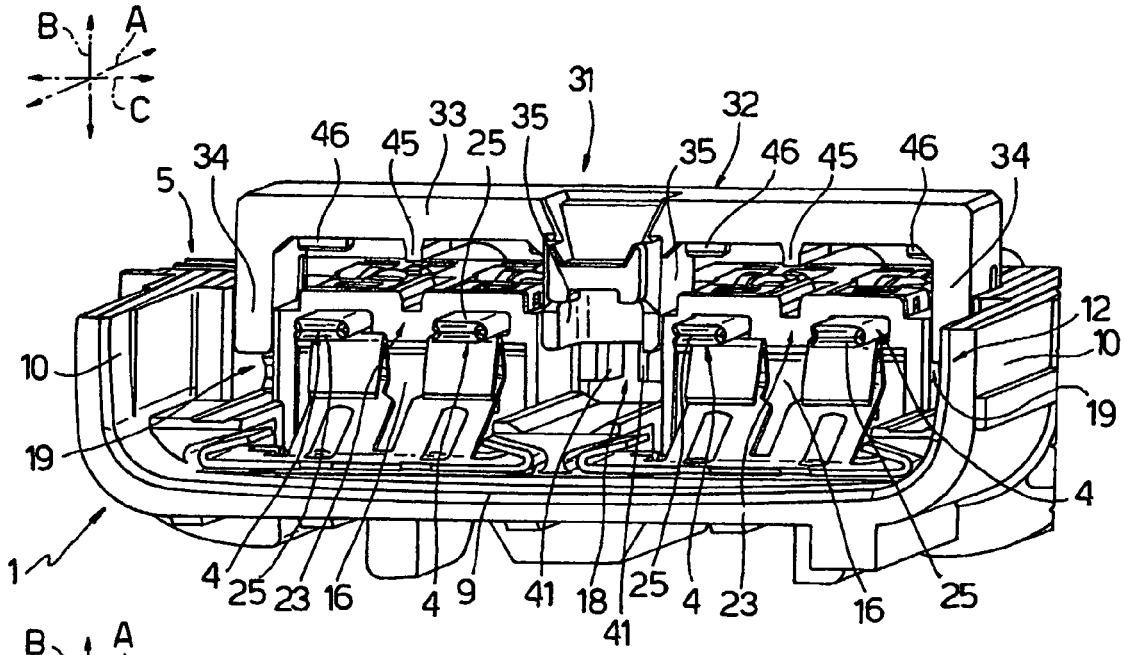
FIGS. 2 and 3 show views in perspective, with parts removed for clarity, of two different configurations of the FIG. 1 connector.
Figure 3:
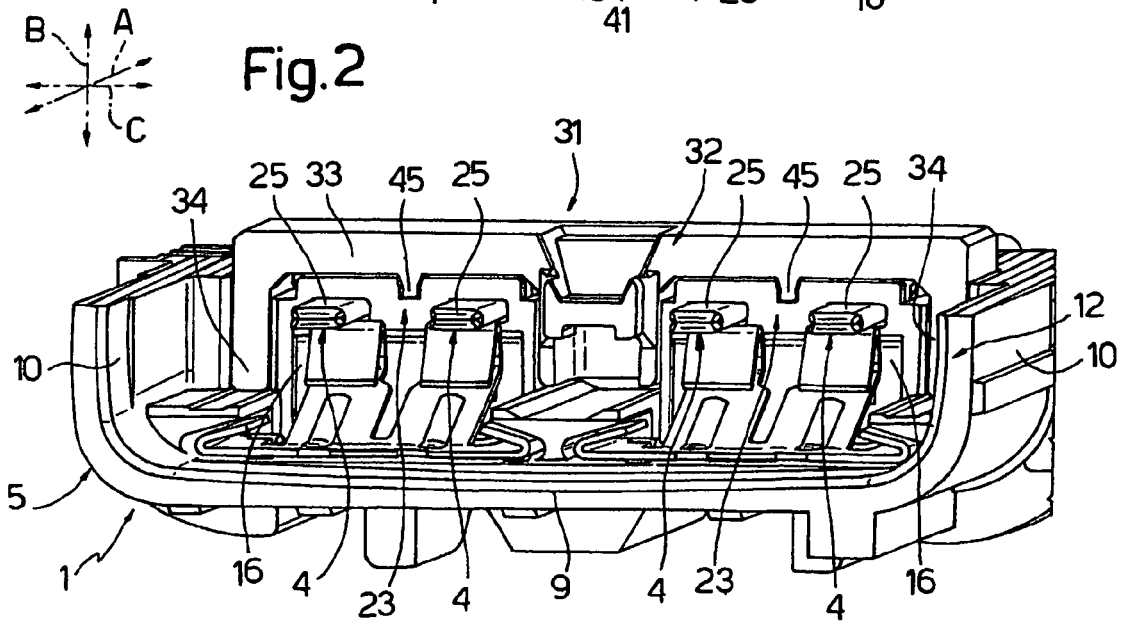
Figure 4:
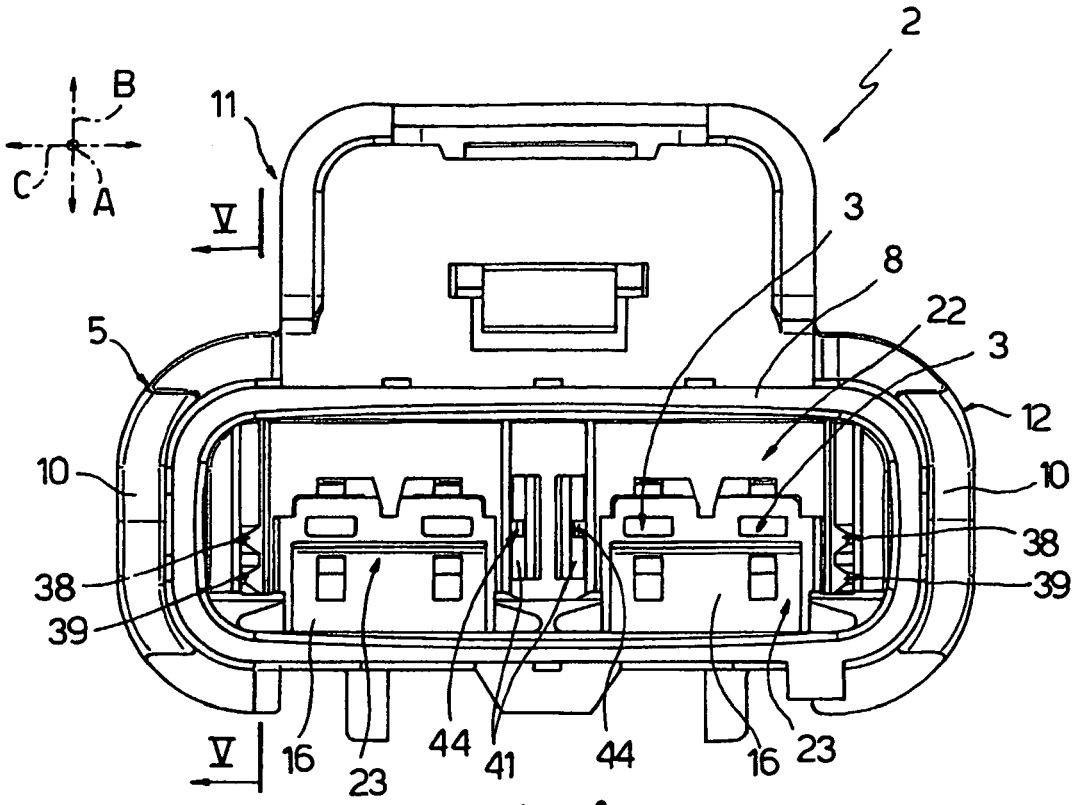
FIG. 4 shows a front view of the FIG. 2 connector.

With reference to FIGS. 1, 2, 3, 6 and 7, movable member 32 is inserted inside hollow front portion 12 of casing 2, in direction A and adjacent to top wall 8, into a primary engaged position engaging casing 2 (FIGS. 2 and 4).

According to an important characteristic of the present invention, movable member 32 is also movable, in a direction B perpendicular to direction A and to top and bottom walls 8, 9, from the primary engaged position to a final engaged position (FIGS. 3 and 7) in which it cooperates with terminals 4 to prevent withdrawal of the terminals from respective cavities 3.

Figure 9:
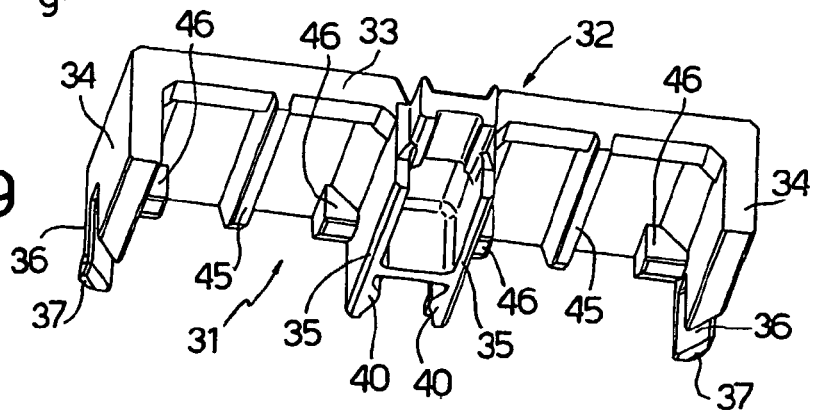
FIGS. 9 and 10 show front and rear views in perspective of a secondary retaining device of the FIG. 1 connector.
Figure 10:
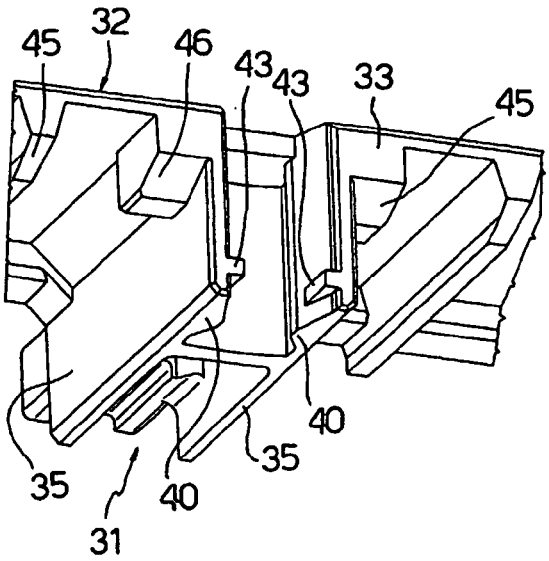

With particular reference to FIGS. 9 and 10, movable member 32 comprises, integrally, a substantially flat rectangular main portion 33, which slides along top wall 8 of front portion 12 of casing 2 when inserting movable member 32 inside inlet 21; two end walls 34 projecting perpendicularly from respective opposite lateral edges of main portion 33; and two intermediate walls 35 projecting perpendicularly from an intermediate portion of main portion 33, and interposed between end walls 34.

As shown clearly in FIGS. 2, 3, 4 and 7, when connecting movable member 32 to main body 5 of casing 2, main portion 33 engages top gap 20, intermediate walls 35 engage central corridor 18, and end walls 34 engage respective lateral corridors 19.

Movable member 32 also comprises, at the front, two elastic retaining lances 36, which project from opposite lateral edges of main portion 33, are aligned with respective end walls 34, and have, on their free ends, respective projections 37 which click inside respective pairs of retaining seats 38, 39 formed at the bottom of lateral corridors 19.

Figure 5:
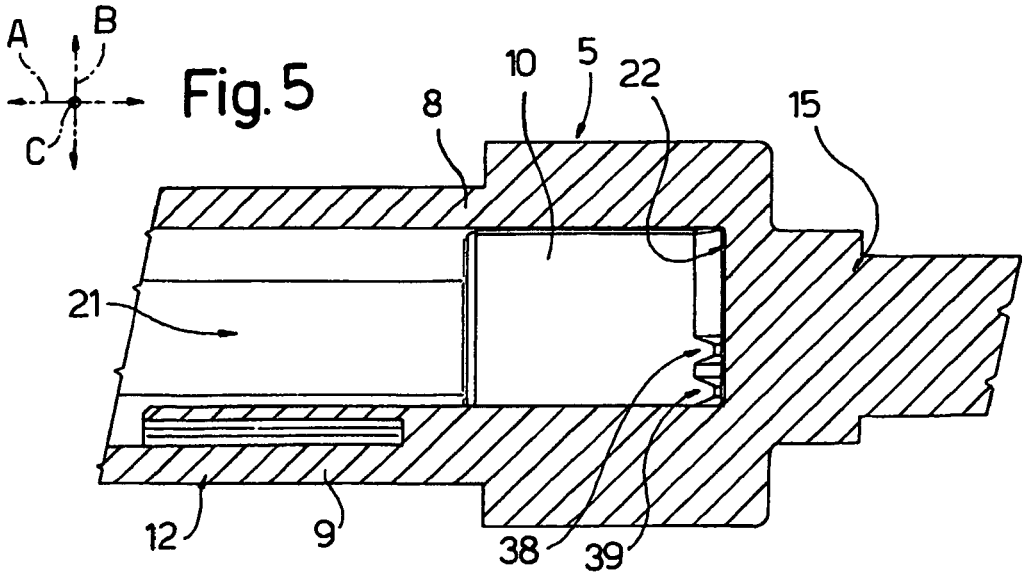
FIG. 5 shows a section along line V-V in FIG. 4.

More specifically, as shown in FIGS. 4 and 5, seats 38, 39 in each pair are formed at the corner between rear surface 22 and a relative lateral wall 10 of casing 2, and are arranged in succession, in a direction parallel to direction B, to respectively define, when engaged by projection 37 of relative lance 36, the primary and final engaged positions of movable member 32. Both seats 38, 39 in each pair are bounded by sides sloping with respect to direction B, so as to permit passage of movable member 32 from the primary to the final engaged position, and vice versa.

As shown in FIGS. 6, 9 and 10, intermediate walls 35 define, at the front, respective facing contoured projections 40, which are engaged by respective elastic lances 41 formed inside central corridor 18 of hollow front portion 12 of casing 2 to prevent withdrawal of movable member 32 from casing 2 in direction A.

More specifically, each projection 40 is defined, on opposite sides in direction A, by respective oblique sides to permit both engagement and release by lances 41. In the example shown, each projection 40 has a substantially isosceles-trapezium-shaped cross section.

Lances 41 project inside central corridor 18 of casing 2 from rear surface 22, are parallel to each other and to direction A along most of their length, and have respective free ends 42 diverging and bent towards respective blocks 16.

Lances 41 are deformable elastically towards each other in a direction C perpendicular to directions A and B, to allow projections 40 of intermediate walls 35 of movable member 32 to slide in direction A along respective surfaces 50 of lances 41 facing blocks 16. Once projections 40 of intermediate walls 35 get past free ends 42, lances 41 spring back into the undeformed configuration, and free ends 42 provide for retaining and preventing withdrawal of movable member 32 from casing 2 in direction A.

Surfaces 50 of lances 41 advantageously define respective guides for guiding movable member 32 in direction B from the primary to the final engaged position.

To ensure a one-only position, in directions A and B, in which to commence engagement of casing 2 by movable member 32, intermediate walls 35 of movable member 32 are provided at the front with respective locating projections 43, which engage respective through seats 44 formed at a predetermined height along free ends 42 of lances 41.

In other words, the primary and final engaged positions of movable member 32 are defined, in direction A, by the front ends of intermediate walls 35 resting against rear surface 22 of casing 2, and by lances 41 engaging projections 40 of intermediate walls 35.

In direction B, on the other hand, the primary and final engaged positions of movable member 32 are defined by lances 36 engaging respective seats 38, 39 in casing 2.

Movable member 32 also comprises two ribs 45 projecting perpendicularly from main portion 33, and each interposed between a relative end wall 34 and a relative intermediate wall 35 facing each other.

Figure 8:
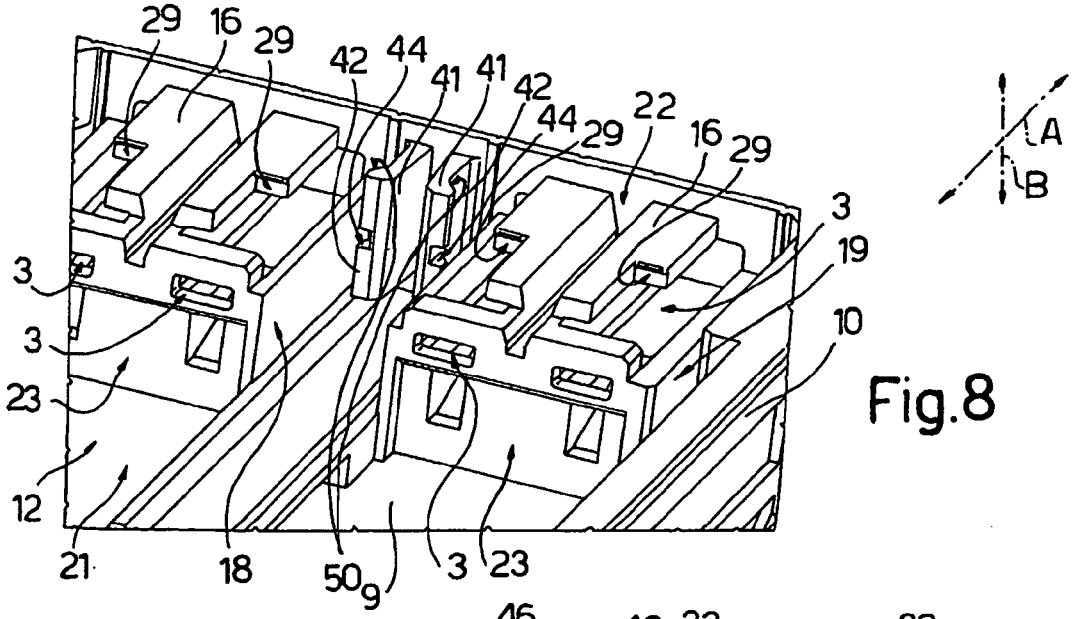
FIG. 8 shows a larger-scale view in perspective of a detail of an outer casing of the FIG. 1 connector.

In the final engaged position of movable member 32, ribs 45 engage respective longitudinal slits formed in blocks 16 and facing top wall 8 (FIGS. 3 and 8).

Finally, movable member 32 comprises a number of front retaining projections 46 projecting from main portion 33, on the same side as ribs 45, intermediate walls 35, and end walls 34, and which, in the final engaged position of movable member 32, define respective stops for terminals 4 in the withdrawal direction from respective cavities 3 in direction A.

More specifically, in the final engaged position of movable member 32, projections 46 engage respective windows in blocks 16, and are positioned behind intermediate portions 24 of terminals 4, and facing, in direction A, the transition surfaces between intermediate portions 24 and connecting portions 26.

Secondary retaining device 31 operates as follows.

Firstly, movable member 32 is inserted, in direction A, inside inlet 21 of main body 5 of casing 2, by sliding main portion 33 along top wall 8. More specifically, movable member 32 must be so positioned that projections 43 on intermediate walls 35 engage seats 44 in lances 41.

As movable member 32 slides in direction A inside hollow front portion 12 of casing 2, main portion 33 engages top gap 20, end walls 34 engage lateral corridors 19, and intermediate walls 35 engage central corridor 18.

As movable member 32 is pushed further in direction A, intermediate walls 35 snap-on fit to lances 41. More specifically, the height, in direction B, at which intermediate walls 35 engage lances 41 is determined by insertion of projections 43 inside respective seats 44.

As projections 40 of intermediate walls 35 slide along free ends 42 of lances 41, lances 41 flex towards each other, and, as soon as projections 40 get past free ends 42, lances 41 spring back into the undeformed position and retain intermediate walls 35 in direction A to prevent withdrawal of movable member 32 from casing 2.

At the same time, projections 37 of lances 36 engage respective seats 38 to secure movable member 32 to casing 2 in direction B and so define the primary engaged or preassembly position of movable member 32.

At this point, terminals 4 are fitted inside respective cavities 3, and movable member 32 can be pushed, in direction B towards blocks 16, into the final engaged position engaging casing 2.

Two situations may arise.

If terminals 4 are all correctly retained inside respective cavities 3 by tabs 28 engaging respective retaining seats 29, retaining projections 46 of movable member 32 are free to move in direction B into position behind intermediate portions 24 of terminals 4. Intermediate walls of movable member 32 can therefore slide in direction B along lances 41 into the final engaged position engaging casing 2 and defined by projections 37 of lances 36 engaging respective seas 39. Connector 1 may then be connected to the complementary connector.

Conversely, if any one of terminals 4 is not inserted fully inside respective cavity 3, intermediate portion 24 of the terminal 4 is located along the path, in direction B, of relative projection 46 of movable member 32. Movable member 32 is therefore prevented from moving into the final engaged position engaging casing 2, thus enabling detection of the fault.

The advantages of connector 1 according to the present invention will be clear from the foregoing description.

In particular, connector 1 employs a front-insertion secondary retaining device (31), i.e. suitable for airtight connecting units, but which also interacts directly with terminals 4 in the final engaged position engaging casing 2, so as to actually also provide for secondary retention, i.e. in addition to that performed by primary retaining means 30.

This is achieved quite simply by designing connector 1 to permit engagement of casing 2 by movable member 32 in two crosswise directions (A, B). At the preassembly stage, i.e. before terminals 4 are inserted inside respective cavities 3, movable member 32 is fitted inside casing 2 in the direction in which connector 1 mates with the complementary connector; and, after terminals 4 are inserted, movable member 32 is moved, crosswise to the mating direction of the connectors, into a final position in which retaining portions (46) of the movable member are positioned facing respective shoulders of terminals 4, so as to define stops for terminals 4 in the withdrawal direction from respective cavities 3.

Clearly, changes may be made to connector 1 without, however, departing from the scope of the present invention.

The invention claimed is:

1. An electric connector comprising:

an insulating casing having at least one cavity for housing a respective electric terminal and having an axis parallel to a first direction (A) in which the connector mates with a complementary connector, said terminal comprising a first end portion adapted for connection to an electric cable and a second end portion opposite said first end portion and extending within an inlet of said casing, said inlet being adapted for receiving a matching shaped portion of the complementary connector;

primary retaining means for retaining said terminal inside said cavity;

secondary retaining means for determining correct engagement of said terminal by said primary retaining means, and comprising at least one movable member which fits inside said casing, in said first direction (A), in a first operating position;

wherein said movable member is movable, in a second direction (B) crosswise to said first direction (A), from said first operating position to a final second operating position in which it cooperates with said terminal to prevent withdrawal of the terminal from said cavity, wherein at least said second end portion of said terminal sticks out of said movable member when said movable member is located in said second operating position, such that a free space is defined around said second end portion of said terminal inside said receiving inlet of said casing.

2. A connector as claimed in claim 1, characterized by comprising first constraint means interposed between said casing and said movable member, and active in said first direction (A) to define at least said first operating position; and guide means for guiding said movable member in said second direction (B) into the final said second operating position.

3. A connector as claimed in claim 2, characterized in that said first constraint means comprise a first and a second retaining member carried by said casing and said movable member respectively, and mutually connectable in said first direction (A); and in that said guide means are defined by a surface of said first retaining member.

4. A connector as claimed in claim 3, characterized in that at least one of said first and second retaining member is flexible elastically in a third direction (C) crosswise to said first and second direction (A, B).

5. A connector as claimed in claim 2, characterized by comprising locating means for defining, in said first and second direction (A, B), a one-only position in which to commence connection of said first and second retaining member.

6. A connector as claimed in claim 5, characterized in that said locating means comprise at least one projection and a through seat), which are formed on said first and second retaining member, in predetermined positions in said second direction (B), and which engage mutually when connecting said first and second retaining member in said first direction (A).

7. A connector as claimed in any claim 2, characterized by comprising second constraint means, which are interposed between said casing and said movable member, are active in said second direction (B), and cooperate with said first constraint means to define said first and said second operating position of said movable member.

8. A connector as claimed in claim 7, characterized in that said second constraint means comprise at least a first and a second retaining seat carried by one of said casing and said movable member, and arranged in succession in said second direction (B); and at least one elastic member carried by the other of said casing and said movable member, and which engages said first and said second retaining seat to respectively define said first and said second operating position of said movable member.

9. An electric connector comprising:

an insulating casing having a first terminal cavity and having an axis parallel to a first direction (A) in which the connector mates with a complementary connector, wherein the insulating casing comprises an inlet adapted for receiving a mating portion of the complementary connector;

a first electrical terminal mounted in the first terminal cavity of the insulating casing, wherein the first electrical terminal comprises a first end adapted for connection to an electrical conductor and an opposite second end at the inlet of the casing;

a primary retainer retaining the first electrical terminal inside the first terminal cavity; and a secondary retainer for determining correct engagement of the first electrical terminal by the primary retainer, wherein the secondary retainer comprises a movable member which fits inside the casing, in the first direction (A), in a first operating position, wherein the movable member is movable, in a second direction (B) crosswise to the first direction (A), from the first operating position to a final second operating position in which the movable member cooperates with the first electrical terminal to prevent withdrawal of the first electrical terminal from the first terminal cavity, wherein the second end of the first electrical terminal sticks out of the movable member when the movable member is located in the second operating position, such that a free space is defined around the second end of the first electrical terminal at the inlet of the casing.

* * * * *